US010161087B1

(12) United States Patent
Oetken

(10) Patent No.: US 10,161,087 B1
(45) Date of Patent: Dec. 25, 2018

(54) SYSTEM AND METHOD FOR ASPHALT HEATING

(71) Applicant: Caterpillar Paving Products Inc., Brooklyn Park, MN (US)

(72) Inventor: Nicholas Alan Oetken, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/832,856

(22) Filed: Dec. 6, 2017

(51) Int. Cl.
*E01C 19/08* (2006.01)
*E01C 19/22* (2006.01)

(52) U.S. Cl.
CPC ..... *E01C 19/08* (2013.01); *E01C 19/22* (2013.01)

(58) Field of Classification Search
CPC ..... E01F 19/08; E01F 19/22
USPC ..... 404/84.05, 85, 87, 95, 79, 118
See application file for complete search history.

(56) References Cited

U.S. PATENT DOCUMENTS 3,554,449 A * 1/1971 Currie ..... C10C 3/12 118/302
4,298,660 A 11/1981 Nakagawa
4,559,276 A 12/1985 Tezuka
5,251,999 A * 10/1993 McCracken ..... E01C 23/06 404/109
6,227,762 B1 * 5/2001 Van Velsor ..... E01C 19/48 404/77
9,845,578 B2 * 12/2017 Marsolek ..... H04W 4/029
2004/0037643 A1 * 2/2004 Naus ..... E01C 5/12 404/31
2005/0167417 A1 * 8/2005 Buschmann ..... E01O 19/48 219/462.1
2006/0204333 A1 * 9/2006 Musil ..... E01C 19/00 404/95
2009/0142133 A1 * 6/2009 Glee ..... E01C 19/004 404/75
2010/0329783 A1 * 12/2010 Weiser ..... E01C 19/48 404/84.05
2012/0261861 A1 10/2012 Bracegirdle
2017/0305800 A1 * 10/2017 Crupi ..... C04B 41/0072

FOREIGN PATENT DOCUMENTS

CN 102182133 9/2011
CN 103787617 5/2014
KR 20150075429 7/2015

* cited by examiner

*Primary Examiner* — Raymond W Addie
(74) *Attorney, Agent, or Firm* — Bookoff McAndrews

(57) ABSTRACT

A paver machine includes an engine, a hopper for receiving a volume of asphalt, and a screed element for spreading the asphalt into an asphalt mat. The machine also includes an induction heating element positioned within the hopper for maintaining a predetermined temperature of the asphalt during operation of the paver machine.

20 Claims, 3 Drawing Sheets

SYSTEM AND METHOD FOR ASPHALT HEATING

TECHNICAL FIELD

The present disclosure relates to a heating system, and more specifically, to a system and method for maintaining a temperature of asphalt.

BACKGROUND

Machines, such as haul trucks, are often used to transport paving material, such as asphalt, to a job site. At the job site the paving material may be transferred to a machine capable of laying the paving material to create a new road surface, such as an asphalt paver. In certain cases, an intermediary vehicle may receive the paving material at the job site and transfer the material to the paving machine. In either case, the asphalt needs to be at a sufficiently high temperature to allow the paver to easily lay the asphalt on a ground surface at the job site and to achieve the required specifications for the finished surface. Thus, the asphalt is initially heated to a prefixed temperature and then transported to the job site via a transport truck or by the paver.

Hence, generally the asphalt is heated to an approximate temperature of 320 F. However, during transportation the asphalt may cool down. On the other hand, it may be required to maintain the temperature of the asphalt within a desirable range to ensure that the asphalt is hot enough to pave and compact at the job site.

United States Published Application Number 2004/0037643 describes a method for realizing a road construction comprising a foundation layer, a road surface provided on top of the foundation layer, and a binder course provided between the foundation layer and the road surface for bonding the road surface to the foundation layer. In the binder course metal particles are incorporated. The metal particles form threads and are iron particles. The binder course comprises bitumen that is incorporated in a fleece.

SUMMARY OF THE DISCLOSURE

In one aspect of the present disclosure, a paver machine is provided. The paver machine includes an engine, a hopper for receiving a volume of asphalt, and a screed element for spreading the asphalt into an asphalt mat. The machine also includes an induction heating element positioned within the hopper for maintaining a predetermined temperature of the asphalt during operation of the paver machine.

In another aspect of the present disclosure, a method for maintaining a predetermined temperature of asphalt is provided. The method includes placing the asphalt into at least one of a truck bed and a hopper of a machine. The asphalt includes metal fibers dispersed therethrough to facilitate heat transfer. The method includes heating the asphalt by an induction heating element associated with the machine for maintaining the predetermined temperature of the asphalt.

Other features and aspects of this disclosure will be apparent from the following description and the accompanying drawings.

DETAILED DESCRIPTION

Figure 1:
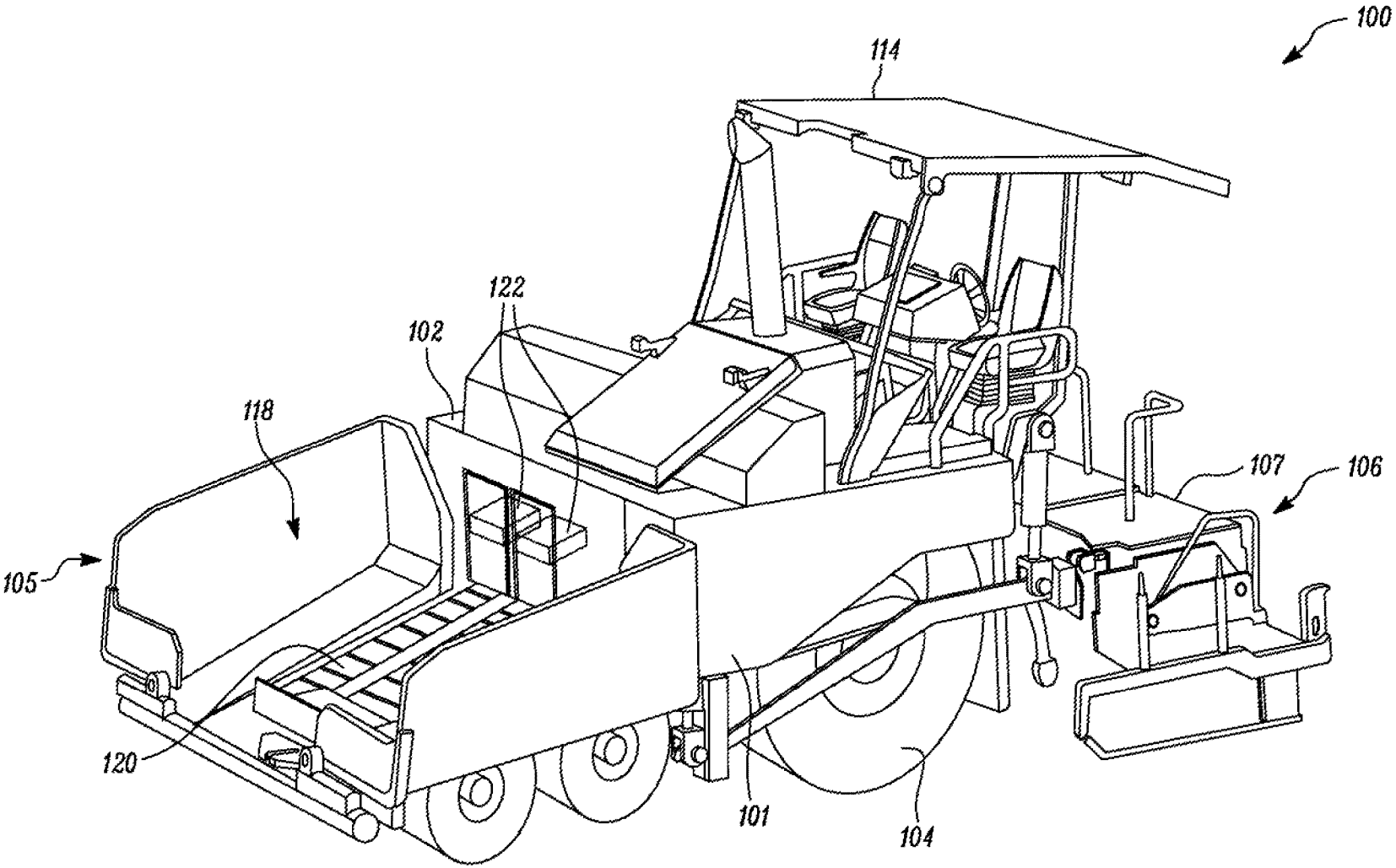
FIG. 1 is a perspective view of an exemplary machine, in accordance with the concepts of the present disclosure.

Referring to FIG. 1, an exemplary machine 100 is illustrated. The machine is embodied as a paver for carrying asphalt. The machine 100 includes a body 101 having a frame 102. The machine 100 also includes one or more traction devices 104 coupled with the frame 102 having a front end 105 and a rear end 106. In the illustrated embodiment, the traction devices 104 are wheels. The traction device 104 may be driven by a power source, e.g., an engine (not shown) via a transmission (not shown). The transmission may be a hydrostatic transmission or a mechanical transmission. The engine may further drive an associated generator (not shown) that is used to power various system on the machine 100.

The machine 100 also includes a screed element 107 that is coupled to the body 101 and attached at the rear end 106 of the frame 102. The screed element 107 is configured to spread and compact the asphalt into a layer or mat of desired thickness, size and uniformity on a ground surface. The machine 100 has an operator station 114, which includes various controls for directing operations of the machine 100. The operator station 114 may also include a user interface (not shown) for accepting user input and displaying information to the operator.

The machine 100 further includes a hopper 118 configured to receive a volume of the asphalt. The machine 100 has a conveyor system including one or more conveyors 120 configured to move the asphalt from the hopper 118 to the rear end 106 of the frame 102. The conveyors 120 are arranged at a bottom of the hopper 118 and, if more than one is provided, may be positioned side-by-side and run parallel to one another to the rear end 106 of the frame 102. The speed of the one or more conveyors 120 is adjustable to control the rate at which the asphalt may be delivered to the screed element 107. In case more than one conveyor 120 is provided, the speed of each of the conveyors 120 may be independently variable to adjust the amount of asphalt delivered to each side of the screed element 107. The machine 100 also includes an auger (not shown) to receive the asphalt supplied by the conveyors 120 and spread the asphalt evenly ahead of the screed element 107.

The present disclosure relates to a heating system 200 (FIG. 2) for maintaining a predetermined temperature of the asphalt that may be required for a paving or compaction process. The heating system 200 includes an induction heating element 122 (see FIG. 1) associated with the machine 100. The induction heating element 122 is provided within the hopper 118 of the machine 100. The induction heating element 122 is positioned such that the asphalt provided on the conveyor of the hopper 118 moves inwards and towards the induction heating element 122, allowing the asphalt to contact with the induction heating element 122. In one example, the induction heating element 122 is positioned directly over the conveyor 120 and under the operator station 114 in a tunnel area of the machine 100. The working of the heating system 200 will now be described in detail.

Prior to placing the asphalt in the hopper 118 of the machine 100, the asphalt is heated to a desired initial temperature. Further, metal fibers are dispersed through the asphalt and allow the asphalt to be heated to a desired temperature through an induction heating means which will be described later in this section. Thereafter, the asphalt mixed with the metal fibers are loaded into the hopper 118 of the machine 100. Alternatively, the asphalt may be loaded in a truck bed of a transport truck.

Figure 2:
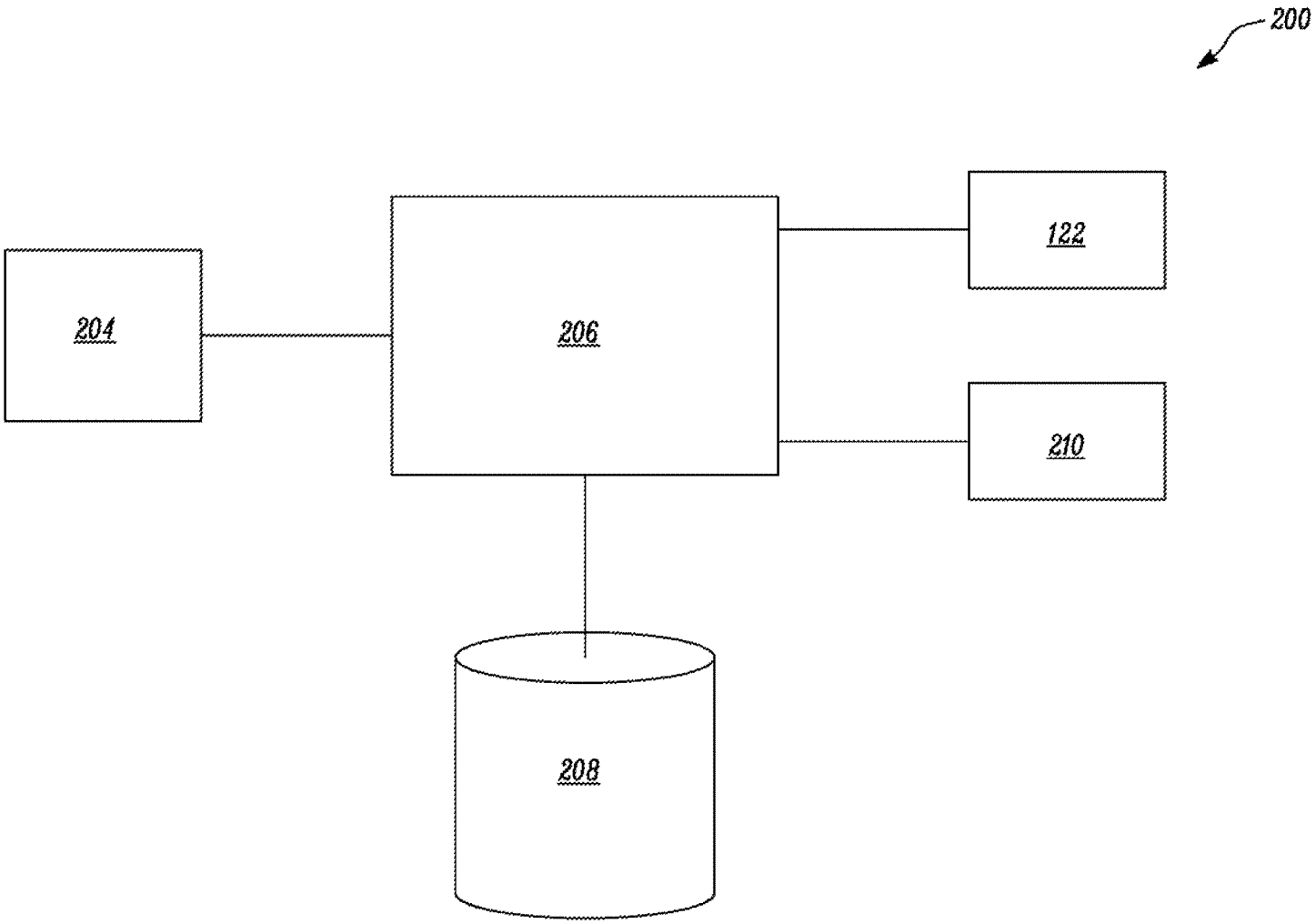
FIG. 2 is a block diagram of a heating system, in accordance with the concepts of the present disclosure.

Referring to FIG. 2, the hopper 118 of the machine 100 includes a temperature sensor 204 for monitoring a current temperature of the asphalt. The temperature sensor 204 is configured to generate a signal indicative of the current temperature of the asphalt. In one example, the temperature sensor 204 may be positioned in such a manner that the asphalt placed within the hopper 118 of the machine 100 contacts the temperature sensor 204 for measuring the current temperature of the asphalt. Alternatively, in case the asphalt is loaded into the truck bed of the transport truck, the temperature sensor 204 is appropriately positioned in the truck bed for sensing the current temperature of the asphalt. It should be noted that the number and positioning of the temperature sensors 204 may vary without any limitation.

The temperature sensor 204 is coupled to a controller 206. The controller 206 receives the signal of the current temperature of the asphalt from the temperature sensor 204. The controller 206 is also coupled to a database 208 or any other storage device. The database 208 includes any known data repository for storing information related to the predetermined temperature at which the asphalt needs to be maintained. The predetermined temperature is greater than the initial temperature of the asphalt.

The controller 206 may access and retrieve this information relating to the predetermined temperature from the database 208. Alternatively, the controller 206 may be coupled to an input device (not shown) in the operator station 114. A user may enter the predetermined temperature through the input device. The input device may include a control panel, a touch screen, or any other known input unit. The controller 206 may accordingly maintain the current temperature of the asphalt at the predetermined temperature based on the user input.

The controller 206 is configured to monitor the current temperature of the asphalt and compare the current temperature of the asphalt with the predetermined temperature. Further, the controller 206 is coupled to the induction heating element 122. In one example, the induction heating element 122 is positioned within the hopper 118 of the machine 100. For example, the induction heating element 122 may be placed on the conveyor 120 within the hopper 118. Alternatively, the induction heating element 122 may be placed within the truck bed of the transport truck. The induction heating element 122 heats the asphalt so that the current temperature of the asphalt is increased to reach the predetermined temperature. Thus, the induction heating element 122 is configured to raise the temperature of the asphalt being carried by the machine 100 as the machine 100 moves along a job site. The induction heating element 122 includes any induction based heating system known in the art. In one example, the induction heating element 122 may raise the current temperature of the asphalt by approximately 20° C.

Based on the comparison between the current temperature of the asphalt and the predetermined temperature, the controller 206 may be configured to control an operation of the induction heating element 122. For example, the controller 206 may either change heat settings associated with the induction heating element 122 to control the working thereof. Alternatively, the controller 206 may change an activation state of the induction heating element 122 by turning the heating on or off based on the comparison.

Further, the controller 206 is coupled to an output device 210 provided in the operator station 114. The output device 210 may include a touch screen, monitor, speaker, or any known output unit. The controller 206 is configured to provide a notification of the current temperature of the asphalt through the output device 210. The controller 206 monitors the temperature of the asphalt on a real-time basis as the asphalt is carried by the hopper 118 of the machine 100 or the truck bed of the transport truck.

The controller 206 may be a microprocessor or other processor as known in the art. The controller 206 may embody a single microprocessor or multiple microprocessors to perform the operations described above. Numerous commercially available microprocessors may be configured to perform the functions of the controller 206. A person of ordinary skill in the art will appreciate that the controller 206 may additionally include other components and may also perform other functions not described herein.

INDUSTRIAL APPLICABILITY

Figure 3:
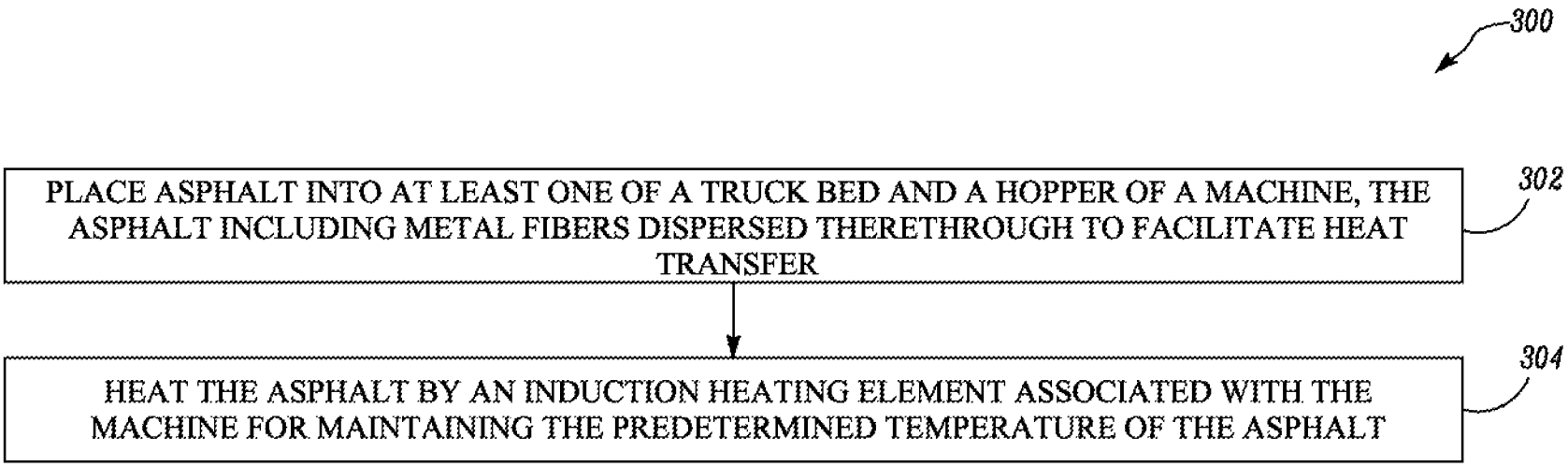
FIG. 3 is a flowchart of a method for maintaining a temperature of asphalt carried by the machine of FIG. 1, in accordance with the concepts of the present disclosure.

The present disclosure provides a system and method 300 for maintaining the predetermined temperature of the asphalt carried by the machine 100. Referring to FIG. 3, at step 302, the asphalt is placed into the truck bed of the transport truck or the hopper 118 of the machine 100. The asphalt includes metal fibers dispersed therethrough to facilitate heat transfer. Further, at step 304, the asphalt is heated by the induction heating element 122 provided on the transport truck or within the hopper 118 of the machine 100 for maintaining the predetermined temperature of the asphalt. The predetermined temperature of the asphalt is greater than the initial temperature of the asphalt prior to loading the asphalt into the transport truck or the machine 100.

The system and method of the present disclosure provides a simple and cost-effective means to maintain the temperature of the asphalt at the predetermined temperature that can be easily installed on the machine 100. Since the temperature of the asphalt is increased by the induction heating element 122, the asphalt need not be initially heated to a very high temperature and can gain heat from the heating system 200. This allows a lower initial temperature at an asphalt plant prior to transport to the job site, saving energy and providing the asphalt with better properties.

Further, using the metal fibers mixed with the asphalt makes it easier for the asphalt to retain and distribute heat. The induction heating element 122 may be installed within the hopper 118 of the machine 100 or the truck bed of the transport truck. In one example, the controller 206 may be present on-board the machine 100 such that the controller 206 processes the data of the given machine 100 and controls the operation of the induction heating element 122 on that machine 100. In another example, the controller 206 may be present off-board the machine 100 and may receive data from multiple induction heating elements 202 provided on different machines 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A paver machine comprising:

an engine;

a hopper for receiving a volume of asphalt, the hopper including a conveyor for moving asphalt;

a screed element for forming the asphalt into an asphalt mat; and an induction heating element positioned within the hopper for maintaining a predetermined temperature of the asphalt during operation of the paver machine, whereby the induction heating element is configured to raise the temperature of metallic elements dispersed through the asphalt in the hopper.

2. The machine of claim 1, wherein the induction heating element is configured to maintain the predetermined temperature of the asphalt on a real-time basis.

3. The machine of claim 1, wherein the induction heating element is positioned in a conveyor of the hopper.

4. The machine of claim 1, further including a controller configured to control a temperature of the asphalt.

5. The machine of claim 4, wherein the controller is coupled to an input device, and wherein the controller is configured to receive a user input indicative of the predetermined temperature associated with the asphalt through the input device.

6. The machine of claim 4, wherein the controller is coupled to a temperature sensor for monitoring a current temperature of the asphalt.

7. The machine of claim 6, wherein the controller is coupled to an output device, and wherein the controller is configured to provide a notification of the current temperature of the asphalt.

8. The machine of claim 6, wherein the controller is configured to:

monitor the current temperature of the asphalt; and compare the current temperature with the predetermined temperature.

9. The machine of claim 8, wherein the controller is further configured to alter heat settings of the induction heating element based on the comparison.

10. The machine of claim 8, wherein the controller is further configured to change an activation state of the induction heating element based on the comparison.

11. A method for maintaining a predetermined temperature of asphalt, the method comprising:

placing the asphalt into at least one of a truck bed and a hopper of a machine, the asphalt including metal fibers dispersed therethrough to facilitate heat transfer; and heating the asphalt by an induction heating element associated with either the truck bed or the hopper of the machine for maintaining the predetermined temperature of the asphalt.

12. The method of claim 11, wherein the predetermined temperature of the asphalt is maintained on a real-time basis.

13. The method of claim 11, further including controlling, by a controller a temperature of the asphalt.

14. The method of claim 13, further including receiving, by the controller, a user input indicative of the predetermined temperature associated with the asphalt through an input device.

15. The method of claim 13, further including monitoring a current temperature of the asphalt using a temperature sensor.

16. The method of claim 15, further including providing, by the controller, a notification of a current temperature of the asphalt through an output device.

17. The method of claim 15, further including:

monitoring, by the controller, the current temperature of the asphalt; and comparing, by the controller, the current temperature with the predetermined temperature.

18. The method of claim 17, further including altering, by the controller, heat settings of the induction heating element based on the comparison.

19. The method of claim 17, further including changing, by the controller, an activation state of the induction heating element based on the comparison.

20. A paver machine comprising:

an engine;

a hopper for receiving a volume of asphalt, the hopper including a conveyor for moving asphalt;

a screed element for forming the asphalt into an asphalt mat; and an induction heating element positioned within the hopper and on or above a portion of the conveyor for maintaining a predetermined temperature of the asphalt during operation of the paver machine.

* * * * *